US009293842B2

(12) United States Patent
Lettkeman

(10) Patent No.: US 9,293,842 B2
(45) Date of Patent: Mar. 22, 2016

(54) GROUNDING CONDUCTOR

(71) Applicant: DISH Network L.L.C., Englewood, CO (US)

(72) Inventor: David Michael Lettkeman, Parker, CO (US)

(73) Assignee: DISH NETWORK L.L.C., Englewood, CO (US)

( * ) Notice: Subject to any disclaimer, the term of this patent is extended or adjusted under 35 U.S.C. 154(b) by 166 days.

(21) Appl. No.: 13/967,569

(22) Filed: Aug. 15, 2013

(65) Prior Publication Data

US 2015/0047869 A1 Feb. 19, 2015

(51) Int. Cl.
*H01R 4/64* (2006.01)
*H01R 24/30* (2011.01)

(52) U.S. Cl.
CPC *H01R 4/64* (2013.01); *H01R 24/30* (2013.01); *H01R 2201/06* (2013.01); *Y10T 29/49117* (2015.01)

(58) Field of Classification Search
CPC ..... H02G 3/08; H02G 3/081; H01R 4/64; H01R 9/00; H01R 9/03; H01R 9/05; H01R 9/24; H01R 9/22; H01R 24/30; H01R 2201/06; H05K 5/00; H05K 5/02; Y10T 29/49117
USPC ..... 174/50, 51, 78, 70 R, 66, 50.5, 520, 115; 439/535, 536; 361/600, 601, 679.01, 361/724, 730, 799; 725/79
See application file for complete search history.

(56) References Cited

U.S. PATENT DOCUMENTS

| | | | | | |
|---|---|---|---|---|---|
| 2,218,830 | A | * | 10/1940 | Rose et al. | 174/115 |
| 3,161,450 | A | * | 12/1964 | Goodenough | 174/66 |
| 3,649,742 | A | * | 3/1972 | Tissot | 174/70 R |
| 5,151,838 | A | * | 9/1992 | Dockery | 725/79 |
| 5,327,230 | A | * | 7/1994 | Dockery | 725/79 |
| 5,914,863 | A | * | 6/1999 | Shen | 174/50 |
| 5,939,672 | A | * | 8/1999 | Tang | 174/50.5 |

* cited by examiner

*Primary Examiner* — Angel R Estrada
(74) *Attorney, Agent, or Firm* — Dorsey & Whitney LLP

(57) ABSTRACT

An electrical device and/or a connected component is grounded utilizing a dedicated listed grounding conductor that permanently connects to a chassis of the electrical device and a grounded receptacle. The grounding conductor is dedicated to and listed for grounding the electrical device and/or connected components. The grounding conductor includes a first portion that is permanently connectible to a chassis of the electrical device, a second portion that is permanently connectible to the grounding receptacle, and a conductor portion that connects the first portion and second portion. In some implementations, the first portion may include a terminal lug that connects to a port of the chassis and may be secured by a nut that may require mechanical assistance to remove. In various implementations, the second portion may include a ring that is operable to receive a screw that mates with a screw hole of the grounding receptacle.

20 Claims, 3 Drawing Sheets

GROUNDING CONDUCTOR

TECHNICAL FIELD

This disclosure relates generally to grounding of electrical devices, and more specifically to a dedicated listed grounding conductor that permanently connects to an electrical device and a grounded receptacle.

SUMMARY

The present disclosure discloses systems and methods for grounding an electrical device and/or connected components utilizing a dedicated listed grounding conductor that permanently connects to a chassis of the electrical device and a grounded receptacle. A grounding conductor may be dedicated to and listed for grounding the electrical device and/or connected components such as connected cables, wiring, and/or other such components. The grounding conductor may include a first portion that is permanently connectible to a chassis of the electrical device, a second portion that is permanently connectible to the grounding receptacle, and a conductor portion that connects the first portion and second portion.

In some implementations, the first portion may include a terminal lug that connects to a port of the chassis and may be secured by at least one nut that may require mechanical assistance to remove. In various implementations, the second portion may include a screw retaining ring that is operable to receive a screw that mates with a screw hole of the grounded receptacle.

In one or more implementations, the grounding conductor may also include a power pass through operable to be connected to the grounded receptacle and a power cord of the electrical device. When the power pass through is connected to the grounding receptacle and the power cord, the power cord may receive power for the electrical device from the grounded outlet.

It is to be understood that both the foregoing general description and the following detailed description are for purposes of example and explanation and do not necessarily limit the present disclosure. The accompanying drawings, which are incorporated in and constitute a part of the specification, illustrate subject matter of the disclosure. Together, the descriptions and the drawings serve to explain the principles of the disclosure.

DETAILED DESCRIPTION

Figure 1A:
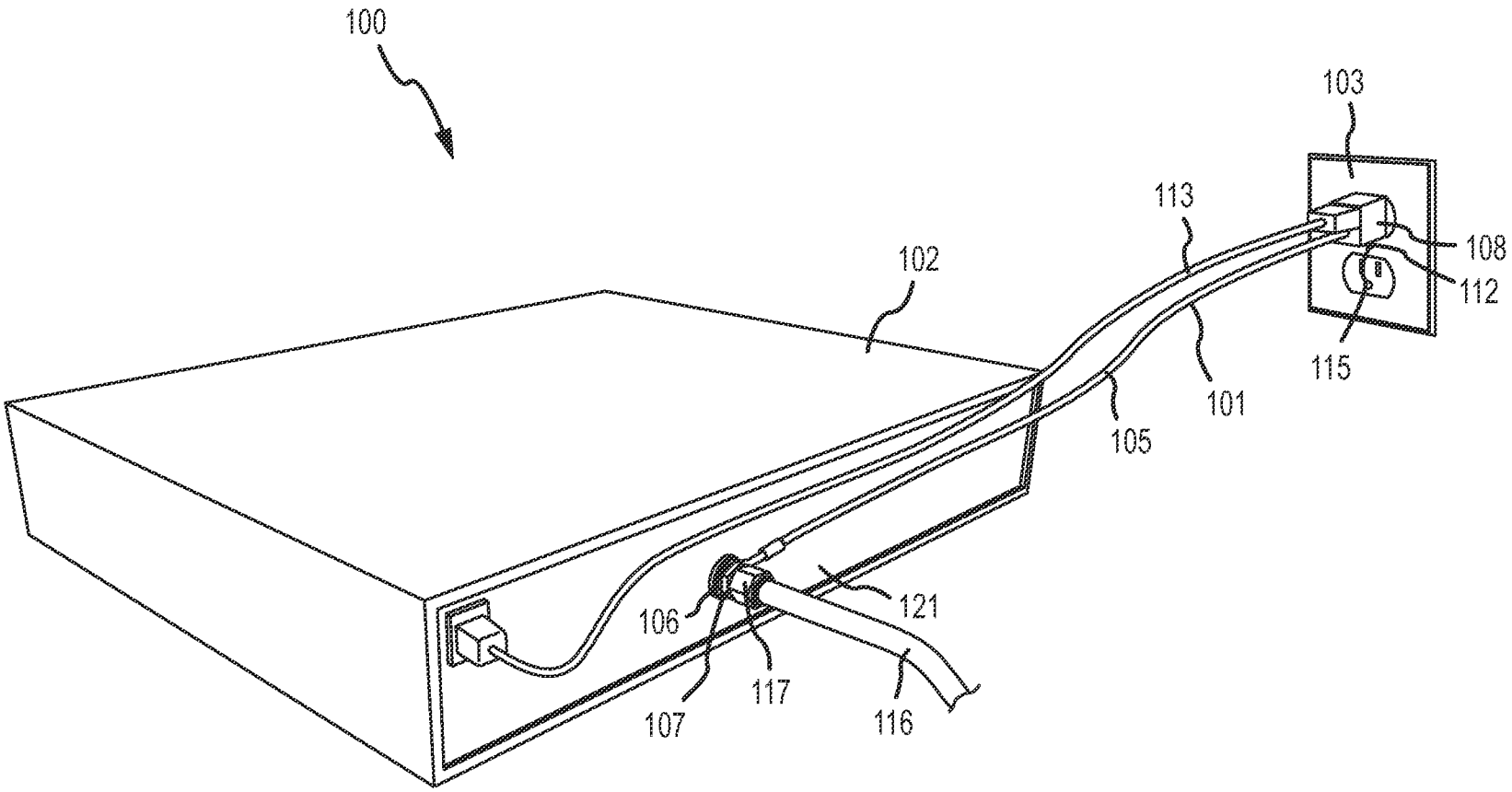
FIG. 1A is an isometric view of a system for grounding an electrical device and/or connected components utilizing a dedicated listed grounding conductor that permanently connects to a chassis of the electrical device and a grounded receptacle.

The description that follows includes sample systems, methods, and computer program products that embody various elements of the present disclosure. However, it should be understood that the described disclosure may be practiced in a variety of forms in addition to those described herein.

Electrical devices (such as set top boxes, computing devices, media players, and so on) often are powered through a connection to an external power source, such as an alternating current (AC) power outlet. However, such electrical devices and/or connected components (such as connected cables, wiring, and/or other connected components) may be vulnerable to power surges due to their connection to such an external power source. Additionally, such electrical devices may be vulnerable to power surges from other sources, such as antennas or other attached components. In order to mitigate possible damage to the electrical devices, or other such dangers such as fire related to power surges, many electrical devices are connected to a ground in order to drain off spurious current.

Many electrical devices are grounded utilizing a ground prong attached to their power cord that plugs into a ground of an AC power outlet. However, some electrical devices may not meet one or more electrical or other codes when using a ground prong of their power plug to provide such grounding.

The present disclosure discloses systems and methods for grounding an electrical device and/or connected components utilizing a dedicated listed grounding conductor that permanently connects to a chassis of the electrical device and a grounded receptacle. A grounding conductor, which may be a dedicated listed grounding conductor for the electrical device and/or connected components, may include a first portion, a second portion, and a conductor portion. The first portion may be permanently connectible to the chassis of the electrical device. The second portion may be permanently connected to a grounded receptacle. The conductor portion may conductively connect the first portion and the second portion, providing a ground for the electrical device.

A device may be "listed" if it is included in a list published by an organization that is acceptable to an authority having jurisdiction and concerned with evaluation of such devices, that maintains periodic inspection of such devices, and whose listing states that either the device meets appropriate designated standards or has been tested and found suitable for a specified purpose. Examples of such organizations may include the American National Standards Institute (ANSI), the Underwriters Laboratories (UL), the Federal Communications Commission (FCC), and/or other such listing organizations.

A device may be "dedicated" if the device performs a single purpose. For example, a grounding conductor that is integrated as a grounding prong of a power cord may not be dedicated because the power cord would perform both the function of providing power and providing ground. However, a grounding conductor that provides grounding without performing other functions may be dedicated.

Thus, a grounding conductor may be dedicated and listed as a grounding conductor for an electrical device and/or connected components if the grounding conductor provides grounding without performing other functions and is included in a list published by an organization described above whose listing states that the grounding conductor meets appropriate designated standards or has been tested and found suitable for grounding the electrical device and/or connected components.

Additionally, a device may be "permanently connected" if the device is attached in such a way that a reliable connection is made such that disconnection would require the use of mechanical assistance. Mechanical assistance may mean that disconnection requires tools or other devices such as one or more wrenches, screwdrivers, or other mechanical aids as opposed to being able to be disconnected using human hands and so on without any mechanical assistance.

Thus, a grounding conductor may be "permanently connectible" to a chassis of an electrical device if the grounding conductor includes attachment mechanisms that can be connected to the chassis such that a reliable connection is made that would require mechanical assistance to disconnect. Similarly, grounding conductor may be permanently connectible to a grounding receptacle if the grounding conductor includes attachment mechanisms that can be connected to the grounding receptacle such that a reliable connection is made that would require mechanical assistance to disconnect.

FIG. 1A is an isometric view of a system 100 for grounding an electrical device 102 and/or connected components (such as a coaxial cable 116, an antenna connected to the coaxial cable, and/or other such connected components) utilizing a dedicated listed grounding conductor 101 that is permanently connected to a chassis 121 of the electrical device 102 and a grounded receptacle 103.

As illustrated, the electrical device 102 is a set top box that connects to a satellite communication receiving antenna or other communication receiving mechanism (not shown) via a coaxial cable 116. However, it is understood that this is for the purposes of example. In various implementations, the electrical device may be device that may be grounded such as a computer, a kitchen appliance, a satellite receiver, a television, a digital media player, a smart phone, a cellular telephone, a tablet computer, a laptop computer, a digital media recorder, an air purifier, and/or any other electrical appliance.

As also illustrated, the grounded receptacle 103 is a grounded AC electrical outlet (i.e., an AC electrical outlet that is connected to a ground). However, it is understood that this is for purposes of example. In various implementations, the grounded receptacle may be any kind of receptacle which is permanently connectible to the grounding conductor 101 in order to provide a ground.

Also further illustrated, the grounding conductor 101 includes a first portion 106 that may be permanently connected to a chassis 121 of the electrical device 102, a second portion 108 that may be permanently connected to the grounding receptacle 102, and a conductor portion 105 that connects the first portion and the second portion.

In this example implementation, the first portion 106 may include a permanent connection mechanism. The permanent connection mechanism may be a terminal lug that may be placed on a port connected to the chassis 121 of the electrical device 102. The port may be a female coaxial cable connector 104 of the electrical device 102 and the terminal lug may be secured with a nut 107 before the male coaxial cable connector 117 of the coaxial cable 116 is connected to the female coaxial cable connector (see also the exploded view of the system 100 FIG. 1B). As the terminal lug may require removal of the nut before the terminal lug may be removed from the female coaxial cable connector and removal of the nut may require mechanical assistance, the terminal lug may be permanently connected to the chassis via the female coaxial cable connector.

However, although this example implementation utilizes a nut 107 to permanently connect the first portion 106 to the female coaxial cable connector 104, it is understood that this is an example. In other implementations, other attachment mechanisms may be utilized to permanently connect the first portion to the chassis 121 of the electrical device 102.

Further, in this example implementation, the second portion 108 may include a plug that is operable to mate with the grounded receptacle 103. The plug may include a grounding prong 110 that is operable to mate with a ground plug hole 119 of the grounding receptacle. The plug may also include a permanent connection mechanism. The permanent connection mechanism may be a screw retaining ring 112 that is operable to receive a screw 115 that may mate with a screw hole 120 of the grounding receptacle (see also the exploded view of the system 100 FIG. 1B). As the plug may require removal of the screw from the screw hole and the screw retaining ring before the plug may be removed from the grounded receptacle and removal of the screw may require mechanical assistance, the plug may be permanently connected to the grounding receptacle via the screw and screw hole.

However, although this example implementation utilizes a screw retaining ring 112 to permanently connect the second portion 108 to the grounded receptacle 103, it is understood that this is an example. In other implementations, other attachment mechanisms may be utilized to permanently connect the second portion to the grounded receptacle.

Additionally, in this example, the conductor portion 105 may be at least one insulated wire that electrically connects the first portion 106 and the second portion 108. By electrically connecting the first portion and the second portion when the first portion is permanently connected to the chassis 121 of the electrical device 102 and the second portion is permanently connected to the grounded receptacle 103, the grounding conductor 101 may ground the electrical device and/or connected components by providing the ground from the grounded receptacle to the electrical device.

However, although this example implementation utilizes one or more wires to connect the first portion 106 and the second portion 108, this is an example. In other implementations, conductor portions other than insulated wires may be utilized, such as non-insulated wires, electrical traces on a substrate, and/or other such conductive mechanisms.

As the grounding conductor 101 may not perform a function other than providing the ground to the electrical device 102 and/or connected components, the grounding conductor may be a dedicated grounding conductor. Further, the grounding conductor may be included in a list published by an organization described above whose listing states that the grounding conductor meets appropriate designated standards or has been tested and found suitable for grounding the electrical device and/or connected components. As such, the grounding conductor may be a dedicated listed grounding conductor.

Figure 1B:
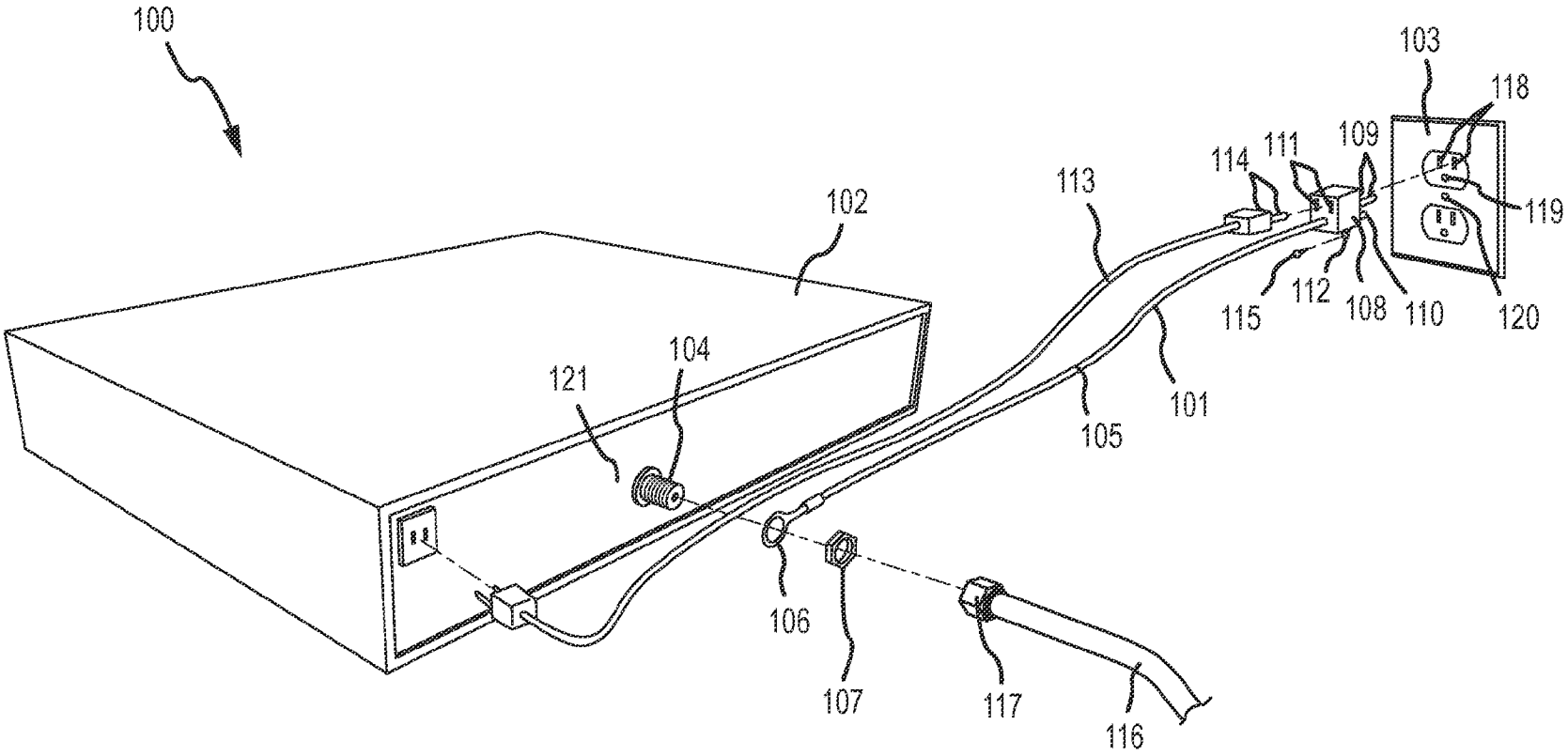
FIG. 1B is an exploded view of the system of FIG. 1.

As additionally illustrated in FIGS. 1A and 1B, the second portion 108 may further include electrical prongs 109 and a power pass through 111. The electrical prongs may mate with electrical plug holes 118 of the grounding receptacle 103. The power pass through may include holes with which power cable electrical prongs 114 of a power cable 113 of the electrical device 102 may mate. When the power cable of the electrical device is connected to the electrical device, the power cable electrical prongs are mated with the power pass through, and the electrical prongs are mated with the electrical plug holes, the power cable of the electrical device may receive power from the grounding receptacle and provide the received power to the electrical device.

However, although the second portion 108 in this example implementation includes the power pass through 111, it is understood that this is an example. In various implementations, the electrical conductor may not include such a power pass through and/or may include components other than those shown.

Figure 2:
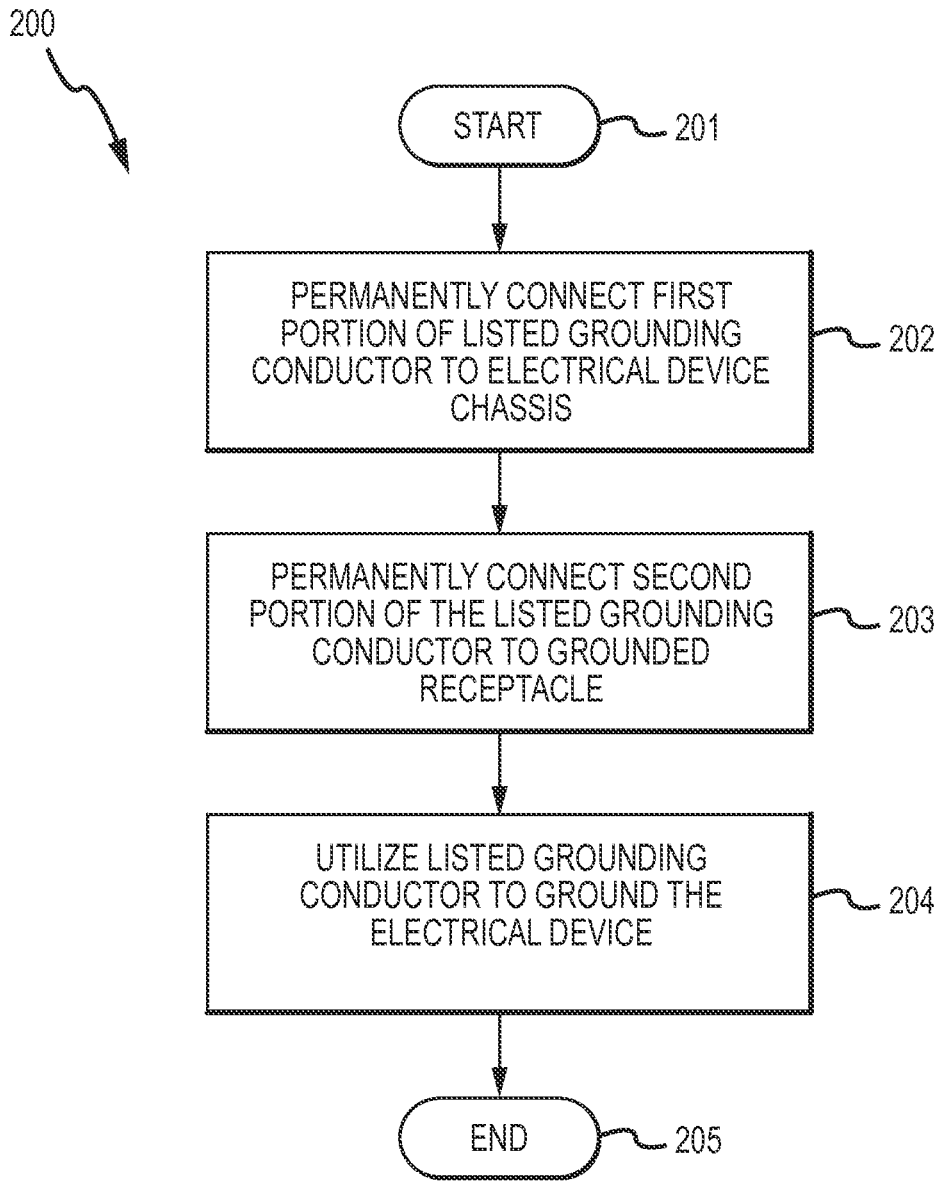
FIG. 2 is a method diagram illustrating a method for grounding an electrical device and/or connected components utilizing a dedicated listed grounding conductor that permanently connects to a chassis of the electrical device and a grounded receptacle. The method may be performed utilizing the dedicated listed grounding conductor of FIGS. 1A and 1B.

FIG. 2 is a method diagram illustrating a method 200 for grounding an electrical device and/or connected components utilizing a dedicated listed grounding conductor that permanently connects to a chassis of the electrical device and a grounded receptacle. The method may be performed utilizing the dedicated listed grounding conductor 101 of FIGS. 1A and 1B.

The flow begins at block 201 and proceeds to block 202.

At block 202, a first portion of a dedicated listed grounding conductor is permanently connected to a chassis of an electrical device. The flow then proceeds to block 203 where a second portion of the dedicated listed grounding conductor is permanently connected to a grounded receptacle. Next, the flow proceeds to block 204 where the dedicated listed grounding conductor is utilized to ground the electrical device and/or connected components.

Finally, the flow then proceeds to block 205 and ends.

In the present disclosure, the methods disclosed may be implemented as sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

I claim:

1. A grounding conductor, comprising:

a first portion that is permanently and electrically connectible to a chassis of an electrical device;

a second portion that is permanently and electrically connectible to a grounded receptacle; and a conductor portion that connects the first portion and the second portion;

wherein the connection between the first portion and the second portion is separable from a connection for providing power to the electrical device from a power source;

wherein the grounding conductor is a dedicated listed grounding conductor for at least one of the electrical device or at least one connected component.

2. The grounding conductor of claim 1, wherein the first portion comprises a terminal lug.

3. The grounding conductor of claim 2, wherein the terminal lug connects to a port on the chassis.

4. The grounding conductor of claim 3, wherein the port comprises a female coaxial connector.

5. The grounding conductor of claim 4, wherein the terminal lug is permanently connectible to the female coaxial connector utilizing a nut.

6. The grounding conductor of claim 4, wherein the female coaxial connector connects to a coaxial cable that is connectible to at least one antenna.

7. The grounding conductor of claim 6, wherein the grounding conductor is operable to ground at least one of the at least one antenna or the coaxial cable when the terminal lug is permanently connected to the female coaxial connector.

8. The grounding conductor of claim 1, wherein the grounded receptacle comprises a grounded outlet.

9. The grounding conductor of claim 8, wherein the second portion comprises a plug that mates with the grounded outlet.

10. The grounding conductor of claim 9, wherein the plug includes a ground prong that mates with a ground plug hole of the grounded outlet.

11. The grounding conductor of claim 9, wherein the plug includes a permanent connection mechanism that is operable to permanently connect the plug to the grounded outlet.

12. The grounding conductor of claim 11, wherein the permanent connection mechanism is operable to permanently connect the plug to the grounded outlet utilizing at least one screw that mates with at least one screw hole of the grounded outlet.

13. The grounding conductor of claim 12, wherein the permanent connection mechanism comprises a ring that mates with the at least one screw.

14. The grounding conductor of claim 8, wherein the plug includes at least one power pass through.

15. The grounding conductor of claim 14, wherein at least one power cord of the electrical device is connectible to the at least one power pass through.

16. The grounding conductor of claim 15, wherein the power cord is operable to receive power when the power cord is connected to the at least one power pass through and the plug is mated with the grounded outlet.

17. The grounding conductor of claim 1, wherein the conductor portion comprises at least one wire.

18. The grounding conductor of claim 1, wherein the electrical device comprises a set top box.

19. A system for grounding at least one of an electrical device or at least one connected component utilizing a dedicated listed grounding conductor that permanently connects to a chassis of the electrical device and a grounded receptacle, comprising:

an electrical device;

a grounded receptacle; and a dedicated listed grounding conductor for at least one of the electrical device or at least one connected component, comprising:

a first portion that is permanently and electrically connected to a chassis of the electrical device;

a second portion that is permanently and electrically connected to a grounded receptacle; and a conductor portion that connects the first portion and the second portion;

wherein the connection between the first portion and the second portion is separable from a connection for providing power to the electrical device from the grounded receptacle.

20. A method for grounding at least one of an electrical device or at least one connected component utilizing a dedicated listed grounding conductor that permanently connects to a chassis of the electrical device and a grounded receptacle, the method comprising:

permanently and electrically connecting a first portion of a dedicated listed grounding conductor for at least one of an electrical device or at least one connected component to a chassis of the electrical device;

permanently and electrically connecting a second portion of the dedicated listed grounding conductor to a grounded receptacle; and utilizing the dedicated listed grounding conductor to ground the at least one of the electrical device or the at least one connected component independent of a connection for providing power to the electrical device from the grounded receptacle.

* * * * *